US007971384B2

(12) United States Patent
Lippard

(10) Patent No.: US 7,971,384 B2
(45) Date of Patent: Jul. 5, 2011

(54) INTERCHANGEABLE SCOPE MOUNT

(76) Inventor: Karl C. Lippard, Colorado Springs, CO (US)

( * ) Notice: Subject to any disclaimer, the term of this patent is extended or adjusted under 35 U.S.C. 154(b) by 216 days.

(21) Appl. No.: 12/352,427

(22) Filed: Jan. 12, 2009

(65) Prior Publication Data

US 2010/0175299 A1 Jul. 15, 2010

(51) Int. Cl.
*F41G 1/387* (2006.01)

(52) U.S. Cl. ..... 42/124; 42/127

(58) Field of Classification Search ..... 42/124, 42/127

See application file for complete search history.

(56) References Cited

U.S. PATENT DOCUMENTS

| | | | | | |
|---|---|---|---|---|---|
| 1,816,195 | A | * | 7/1931 | Redfield | 42/127 |
| 1,837,290 | A | * | 12/1931 | Redfield | 42/127 |
| 2,563,849 | A | * | 8/1951 | Lebherz | 42/126 |
| 2,580,246 | A | * | 12/1951 | Schall | 42/127 |
| 2,743,526 | A | * | 5/1956 | Ivy | 42/126 |
| 2,763,930 | A | * | 9/1956 | Ivy | 42/127 |
| 3,276,127 | A | * | 10/1966 | Abrahamson | 42/125 |
| 3,483,623 | A | * | 12/1969 | Kruzell | 42/127 |
| 3,559,940 | A | * | 2/1971 | Kruzell | 42/127 |
| 3,880,389 | A | * | 4/1975 | Burris | 248/205.1 |
| 4,205,473 | A | * | 6/1980 | Wilson | 42/127 |
| 4,501,071 | A | * | 2/1985 | Manske | 42/127 |
| 4,509,282 | A | * | 4/1985 | McMillon | 42/124 |
| 4,776,126 | A | * | 10/1988 | Williams | 42/125 |
| 4,873,779 | A | * | 10/1989 | Ellison et al. | 42/124 |
| 5,070,637 | A | * | 12/1991 | French | 42/122 |
| 5,144,752 | A | * | 9/1992 | Boeke et al. | 42/126 |
| 5,337,506 | A | * | 8/1994 | Klotz | 42/124 |
| 5,390,419 | A | * | 2/1995 | Sirkis | 42/127 |
| 5,396,725 | A | | 3/1995 | Talbot | |
| 5,425,191 | A | * | 6/1995 | Taylor et al. | 42/124 |
| 5,531,039 | A | * | 7/1996 | Gore | 42/124 |
| 5,533,267 | A | * | 7/1996 | Haight, Jr. | 42/124 |
| 5,669,173 | A | * | 9/1997 | Rodney, Jr. | 42/124 |
| 5,680,725 | A | * | 10/1997 | Bell | 42/127 |
| 5,694,712 | A | | 12/1997 | Plonka | |
| 5,926,964 | A | * | 7/1999 | Korapaty | 42/124 |
| 5,941,006 | A | * | 8/1999 | Horton | 42/124 |
| 6,026,580 | A | * | 2/2000 | LaRue | 42/127 |
| 6,594,938 | B2 | * | 7/2003 | Horton | 42/127 |
| 6,598,333 | B1 | * | 7/2003 | Randazzo et al. | 42/127 |
| 6,701,660 | B2 | | 3/2004 | Stover | |
| 6,722,074 | B1 | * | 4/2004 | Farrell | 42/124 |
| 7,204,052 | B2 | | 4/2007 | Swan | |
| 7,308,772 | B1 | * | 12/2007 | Millett | 42/127 |
| D563,501 | S | | 3/2008 | Salva | |
| 7,444,776 | B2 | * | 11/2008 | Adams | 42/127 |
| 2003/0056417 | A1 | * | 3/2003 | Horton | 42/124 |
| 2003/0154641 | A1 | * | 8/2003 | Stover | 42/124 |

(Continued)

*Primary Examiner* — Bret Hayes
(74) *Attorney, Agent, or Firm* — Michael C. Martensen

(57) ABSTRACT

A system for interchangeably mounting sighting devices on a plurality of firearms which includes one or more ring assemblies and one or more mounting assemblies. A sighting device is coupled to a mounting assembly using a ring assembly forming a mounting system. The system can then be mounted to one or more firearms using a single connector via two receptacles in the surface of the firearm. An entirely different sighting device and associated mounting system can be exchanged with the existing sighting device by removing the existing mounting system and replacing it with the new sighting device and mounting system. Each sighting device and mounting system are configured to have identical mounting assemblies that interface into standard receptacles in the firearm. In a similar manner a single sighting device and associated mounting system can be mounted on several firearms that each possess the two mounting receptacles.

18 Claims, 7 Drawing Sheets

U.S. PATENT DOCUMENTS

| | | | | |
|---|---|---|---|---|
| 2003/0192224 | A1 | 10/2003 | Kirk | |
| 2004/0148842 | A1* | 8/2004 | Aalto et al. | 42/127 |
| 2005/0241212 | A1* | 11/2005 | Swan | 42/127 |
| 2006/0010758 | A1* | 1/2006 | Zeh | 42/124 |
| 2006/0123686 | A1* | 6/2006 | Larue | 42/127 |
| 2007/0186459 | A1* | 8/2007 | Horton | 42/127 |
| 2007/0266611 | A1* | 11/2007 | Stover | 42/124 |
| 2008/0034638 | A1* | 2/2008 | Spuhr | 42/127 |
| 2009/0133311 | A1* | 5/2009 | Hollenbach et al. | 42/124 |
| 2010/0043271 | A1* | 2/2010 | Williams et al. | 42/124 |

* cited by examiner

INTERCHANGEABLE SCOPE MOUNT

BACKGROUND OF THE INVENTION

1. Field of the Invention

Embodiments of the present invention relate, in general, to optical scopes for firearms and particularly to a mounting and ring system enabling one or more scopes to be interchangeable with one or more firearms.

2. Relevant Background

The invention of the firearm brought with it the challenge of aiming. Beyond the inherent accuracy or inaccuracy of a weapon is the ability of the user to consistently aim the weapon so as to achieve the weapon's full potential. Thus with the arrival of firearms came the arrival of means to aim the weapon through the use of sights. Weapons typically have fixed aiming devices incorporated into their body. Normally these fixed sights include a front and rear sight and in some cases the rear sight is adjustable to compensate for elevation and drift attributed to wind. In addition to these fixed sights, numerous auxiliary sights have been developed to further aid the user in identifying where exactly the fired projectile will impact.

In the prior art, auxiliary sighting devices are typically rigidly mounted onto the top of the firearm receiver. Generally, these prior art firearms, such as rifles, shotguns, black-powder weapons and handguns, include spaced apart attachment points located on the top surface of the receiver that are used for attaching an auxiliary device such as a sighting scope. Such sight attachment points serve to position and secure the auxiliary sighting device above the barrel of the firearm and roughly align the sighting device with the barrel of the firearm. The scope is then adjusted so that it is more precisely sighted relative to the firearm to provide an accurate and positive alignment between the aiming point of the sight and the barrel of the firearm.

There are numerous different types and configurations of scope mounting devices known in the prior art, each of which includes its own design problems and disadvantages. Generally, these prior art mounting devices encompass and hold a sighting scope within in a scope holding portion which is then attached to a base, which is in turn mounted onto the attachment points on the receiver of a firearm. The standard and most widely used method for mounting scopes on firearms includes a combination of a scope base (also referred to herein as scope mount or simply mount) and scope rings. The scope base is a platform that is securely attached to the firearm to provide a mounting platform that is configured to receive the rings. The rings are typically formed as cylindrical clamps that are placed around the scope body or "tube" and fastened in place in the base. The rings also include lower mounting portions that then allow the rings, with the scope mounted therein, to be secured to the base either permanently or in removable engagement. These types of mounting devices are generally mounted using a variety of screw fasteners requiring the use of a tool, such as a screwdriver or Allen wrench, to firmly seat and retain the scope holding portion on the base or to remove the scope holding portion from the base. Thus, it is often difficult and time consuming to attach and/or remove the scope from the base just as it is difficult and time consuming to remove the base from the receiver of the weapon.

Additionally, there are many different scope ring/base combinations that are available in the prior art. One popular style known to those skilled in the art is the "Weaver" system, which utilizes longitudinal rail-type bases that are mounted onto the upper receiver of the firearm. The rings wrap around the barrel of the scope and are transversely clamped to the rails. In connection with the Weaver type system, a "quick release" concept in which the rings, with the scope mounted therein, can be mounted and dismounted and quickly reattached without the need for re-zeroing the scope. In the Weaver system however, the mounts remain affixed to the weapon and the mounts used on one weapon may not be compatible with the mounts and scope associated with another weapon.

Another mounting configuration is the popular "rotary dovetail" style in which a base is provided with a ring-receiving slot, a mating dovetail portion of the scope ring is dropped into the slot and the ring is rotated 90 degrees into locking alignment with the receiver and barrel. Yet another style is the "Ruger.®. dovetail" system in which a dovetail "base" is actually machined into the firearm's receiver, and specially mated rings are clamped on with heavy screws.

All of the foregoing systems have drawbacks or disadvantages fundamental to traditional ring mount systems. One problem is the need for rings of different heights to mount scopes with different objective lens diameters on the same firearm. For example, a scope with a small objective lens diameter or "bell" (e.g., 20 32 mm lens) might be mounted to a rifle using "low" height ring mounts; a medium bell (e.g., 33 42 mm lens) might require "medium" height ring mounts for the same firearm; and, a large-belled scope (e.g., 44 56 mm lens) would require a "high" ring mount. There are also times when it may be desirable to adjust the mounting height of the scope for the sighting comfort of the shooter, or to allow sufficient clearance for backup use of the firearm's fixed sights that are located beneath the scope.

To further complicate the issue, firearms that are utilized in the military must be constructed to be relatively durable and capable of withstanding wide variations in atmospheric conditions and substantial physical shock. Telescopic sights, in contrast, are relatively delicate optical instruments that are vulnerable to variations in atmospheric conditions and to physical shock. A sharp blow to a telescopic sight will often shift its point of aim. As a result, firearms with permanently attached telescopic sights must be treated delicately.

Another significant problem arises when gun manufacturers use a variety of different mounting patterns for scopes on the top of their guns and rifles. In order to achieve the secure attachment necessary for a scope, individualized mounts have been required for the various manufacturers of guns or rifles on the market. Each scope and gun combination becomes unique.

Hunters often prefer to use a single scope on several different rifles. In order for them to change rifles to accommodate a single scope, they would have to remove the scope from the mount of one rifle, and attach it to a separate and often different mount for the second rifle. Accordingly, when the hunter removes the scope from a first mount and attaches it to the second mount of the second rifle, he would have to realign the reticles of the scope with respect to the mount, as well as adjust the eye relief distance of the scope and zero it before use. Eye relief relates to the distance between the shooters eye and the end of the scope through which the shooter seeks his target. This process takes skill and time, notwithstanding the need for the hunter to purchase a separate scope mount for each individual gun.

Another significant deficiency of the scope mounting systems of the prior art is the destruction of a weapon's aesthetics. For many, a weapon or firearm is a utilitarian piece of equipment. In essence, it becomes simply a device that fires a projectile at a target. Its value resides purely in its ability to accurately and consistently hit that target. Thus the price of the scope and its mounting system can often equal or exceed the actual cost of the weapon. However for others, a firearm is more akin to a piece of art and somewhat of a status symbol. Its construction, operation and beauty in its styling all contribute to the weapon's value. Indeed many weapons are engraved with scrollwork and insignias requiring intricate manufacturing techniques. The price of such firearms can easily surpass that of a simple utilitarian model making the added expense of a scope trivial. Owners of such firearms are appalled at the prospect of permanently disfiguring a firearm to attach a scope and or mounting system. And while they desire the ability to accurately employ the weapon using technology afforded to them by the use of a scope, they would prefer to be able to quickly but temporarily mount the scope to the weapon and then remove the scope and mount thereafter. And, indeed, owners of such weapons often possess multiple types of weapons and multiple scopes.

The prior art does not provide a system by which a single scope can be consistently, reliably, and quickly mounted on a plurality of firearms, in which that same system allows multiple scopes to be consistently, reliably and quickly mounted to a single weapon, and in which the same system leaves the aesthetics of the weapon unchanged. These and other deficiencies of the prior art are addressed by one or more embodiment of the present invention.

SUMMARY OF THE INVENTION

An apparatus interchangeably mounts a sighting device on a firearm. According to one embodiment of the present invention a ring assembly couples a sighting device such as a telescopic scope to one or more mounting assemblies. The system comprising ring assemblies, sighting device and mount assemblies, can thereafter be interchangeably mounted on one or more firearms. In addition, a different sighting device using the same mounting system can be interchanged with an existing sighting device on the same firearm with minimal interaction.

In one embodiment of the present invention a mount assembly engages a firearm at two distinct locations on the firearm. The first location includes a receptacle machined into the firearm configured to accept a corresponding portion extending the mount assembly. The second location includes an angled receptacle suitable for receiving a connector. The mount assembly first engages the receptacle at the first location and is then positioned to receive a connector that traverses the mount assembly into the angled receptacle. By tightening the single connector, the mount assembly is securely affixed to the firearm at both the first and second location. In addition, by the design of the first and second receptacles and their corresponding components on the mount assemblies, the sighting device contained within the rings associated with the mount assembly is aligned with the firearm.

According to another embodiment of the present invention a single sighting device can be mounted on a plurality of firearms. First, the single sighting device is mounted to one of the plurality of firearms using a mounting system that includes at least two ring assemblies and at least two mount assemblies. As previously described the ring assemblies couple the single sighting device to the mount assemblies respectively. The firearm includes a first set of two or more recesses configured to accept a portion of each of the at least two mount assemblies.

Once mounted and aligned for firing, the mounting assembly including the sighting device is removed leaving on the firearm only the two recesses machined into the firearm's surface. Thereafter the sighting device still attached to the mounting assemblies via the rings can be mounted on a second firearm having identical recesses in its surface. Once mounted on the second firearm by tightening the single connector, the sighting device is aligned with the firearm line of fire and with a single elevation adjustment ready for use.

In another embodiment several types of sighting devices can be interchangeably mounted on the same firearm. Each of a plurality of sighting devices is coupled to a mounting assembly via a set of rings. Each mounting assembly includes two portions wherein one of the two portions is aligned with one of two recesses machined into the surface of the firearm. A first recess is configured to accept an extension of the mounting assembly and the second recess or hole is configured to be aligned with a corresponding hole in the second portion of the mounting assembly. The aligned holes are coupled by a connector which when tightened draws the mounting assembly to the firearm at the location of the two recesses.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein.

Figure 1:
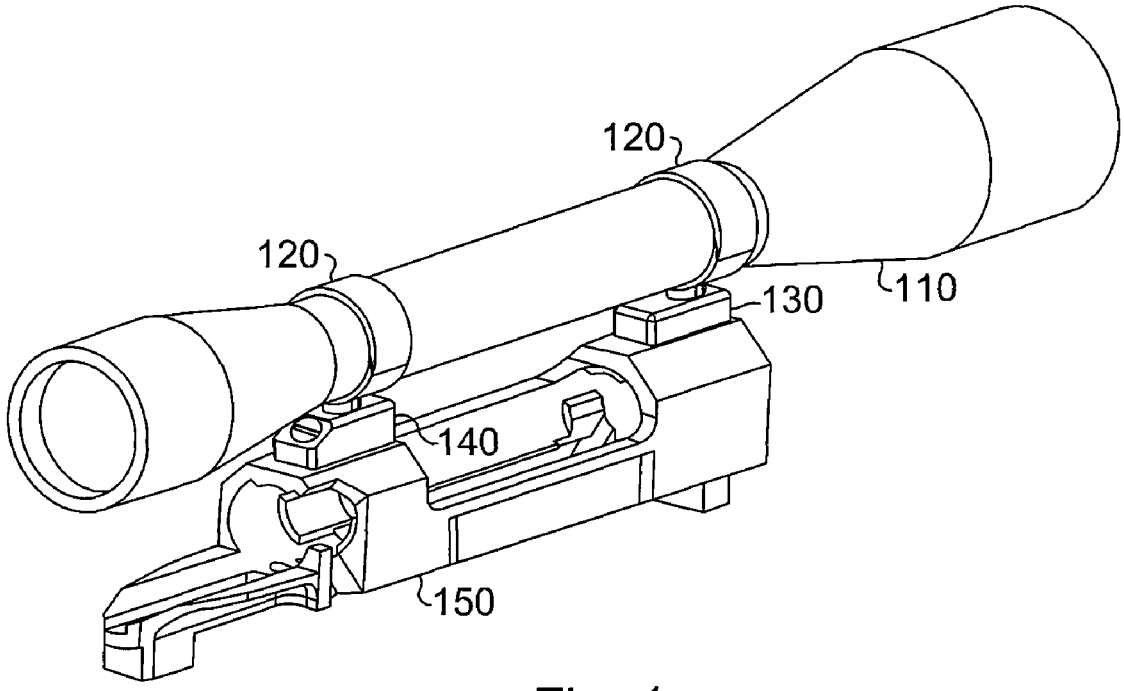
FIG. 1 shows a perspective view of a sighting device mounted to a portion of a firearm using a mounting system according to one embodiment of the present invention.

The Figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF EMBODIMENTS

A system for interchangeably mounting a sighting device to a firearm is hereafter disclosed by way of example. According to one embodiment of the present invention a mounting system comprising one or more mounting assemblies and one or more ring assemblies couples a sighting device to a firearm. The mounting system when combined with a sighting device becomes a single component capable of being interchanged between a plurality of firearms. In another embodiment, multiple sighting devices can be configured with mounting assemblies and rings to form a plurality of mount ready sighting devices that can interchanged on a single firearm. Significantly, the components interfacing the mount assemblies to the firearm are entirely contained within the mount assemblies leaving the firearm upon removal of the sighting device and mounting system void of any external components.

Specific embodiments of the present invention are hereafter described in detail with reference to the accompanying Figures. Like elements in the various Figures are identified by like reference numerals for consistency. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

FIG. 1 shows a perspective view of an interchangeable sighting device mounting system according to one embodiment of the present invention. As shown, a sighting device 110 is coupled to a first and second mounting assembly 130, 140 (respectively) via a pair of ring assemblies 120. The mounting assemblies 130, 140 are further coupled to a portion of a firearm 150. In this particular rendition the portion of the firearm 150 is shown to be the receiver section. One skilled in the relevant art will recognize that while embodiments of the invention are depicted with reference to a firearm's receiver and its associated components, the mounting system of the present invention can be configured to interface with a plurality of firearms. The depictions for the firearm portions shown in the Figures of the present invention are shown as a representative surface by which the mount assemblies can engage the firearm and are not meant to be limiting in any way.

Figure 2:
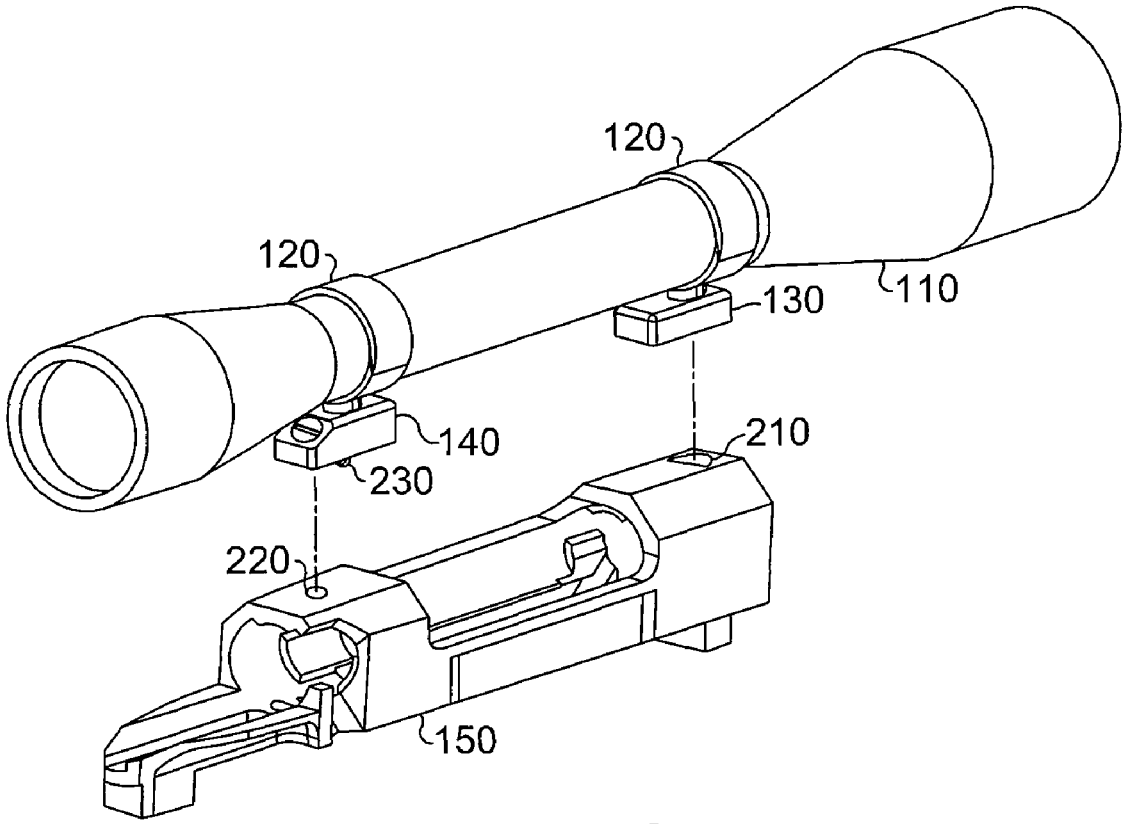
FIG. 2 shows the sighting device coupled to a mounting system according to one embodiment of the present invention apart from a portion of a firearm.

FIG. 2 shows the sighting device coupled to a mounting system apart from the firearm according to one embodiment of the present invention. The mounting system, collectively the mounting assemblies 130, 140 and the mounting rings 120 when combined with a sighting device, form an interchangeable sighting device component. Each mounting assembly 130, 140 engages the firearm 150 so as to align the sighting device 110 with the bore sight of the firearm 150. One skilled in the art will recognize that the bore sight of a firearm is the longitudinal line upon which the projectile fired from the firearm will travel. Upon firing, the fired projectile accepts the directional bore of the barrel. Thus, aiming a firearm involves controlling lateral (left or right) and vertical (up and down) displacement of the weapon's bore. Vertical displacement of the barrel for a known projectile velocity controls distance to impact as once the projectile leaves the barrel it begins to fall due to the forces of gravity. By adjusting the trajectory (loft) of the projectile, the range to impact can be controlled. As one skilled in the relevant art will recognize other factors such as the type of projectile, exit velocity, atmospheric conditions, and the like also affect the travel of a projectile.

To be effective, a sighting device must be aligned with the bore of the firearm and then adjusted for elevation based on the desired range of impact for a given projectile. According to one embodiment of the present invention the mounting assemblies 130, 140 interface with the firearm 150 so as to consistently and reliably align the sighting device to the bore sight of the firearm 150. As shown in FIG. 2, two receptacles 210, 220 are machined out of the firearm 150 and configured to accept corresponding components of the mounting assemblies 130, 140.

A first receptacle 210 is machined into the surface of the firearm 150 and configured to engage an extension of one mount assembly 130. In one embodiment of the present invention the first receptacle is substantially semicircular in shape as viewed from the top of the firearm. The receptacle invades the surface of the firearm with increasing depth with the shallow portion being oriented toward the outer portion of the sighting device 110 and the deeper portion being oriented toward the center of the sighting device 110. The interface of the extension found on the mounting assembly 130 and the receptacle 210 found in the firearm 150 is such that the engagement aligns the sighting device to the bore sight of the firearm 150.

A second receptacle 220 is also machined into the surface of the firearm 150. Unlike the first receptacle, the second receptacle 220 is designed to accept a connector 230 at an angle which actively draws the mounting assembly 140 to the firearm 150 as the connector 230 is tightened. In addition the connector 230 securely engages the extension of the first mount assembly 130 into the first receptacle 210. The connector 230 is configured to singularly secure the sighting device 110 to the firearm 150.

Figure 3:
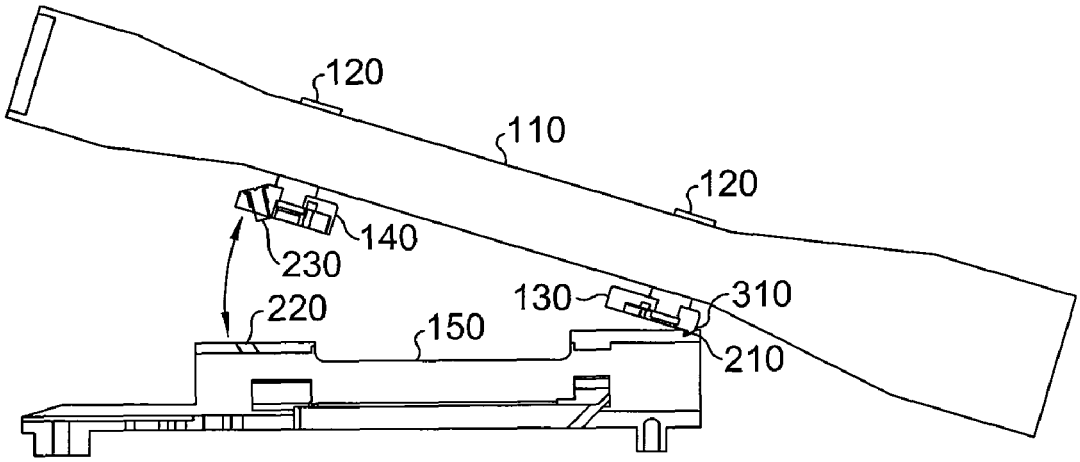
FIG. 3 shows a side cutaway view of a sighting device coupled to one embodiment of a mounting system according to the present invention in an intermediary phase of attachment to a portion of a firearm.

FIG. 3 shows a side cutaway view of a sighting device coupled to one embodiment of a mounting system according to the present invention in an intermediary phase of attachment to a portion of a firearm. Once a sighting device 110 is secured to the mounting assemblies 130, 140 via the ring assemblies 120, the entire system engages the firearm 150 by fitting an extension 310 of the first mount assembly 130 into the first receptacle 210. Thereafter the system is affixed to the firearm 150 by rotating the system down to align the connector 230 with the second receptacle 220. A connector such as a screw, bolt, clasp, lever or other similar device engages the firearm 150 drawing the second mount assembly 140 to the firearm vertically and simultaneously drawing both of the mount assemblies 130, 140 rearward (in this embodiment) to further secure the first mount assembly 130 and align the sighting device 110 to the bore sight of the firearm 150.

Figure 4:
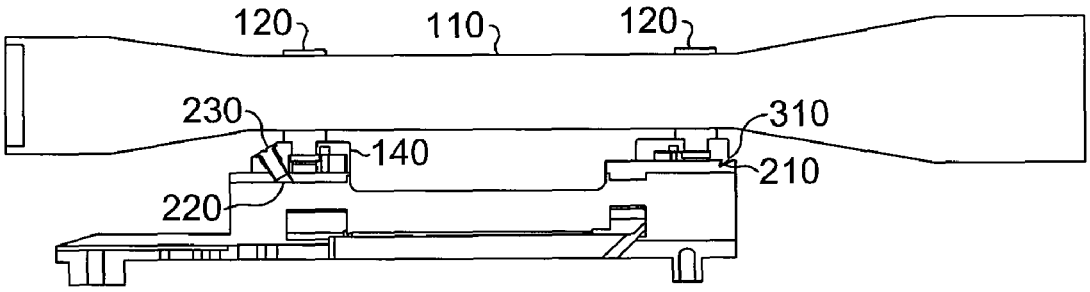
FIG. 4 shows a side cutaway view of the sighting device and mounting system of FIG. 3 mounted on a portion of a firearm.

FIG. 4 shows a side cutaway view of the sighting device 110 and mounting system of FIG. 3 mounted on a portion of a firearm 150, according to one embodiment of the present invention. While the embodiment shown in FIGS. 3 and 4 depict two separate mounting assemblies 130, 140 one skilled in the relevant art will recognize that the mount assemble can comprise a unitary component having the features of both depicted mount assemblies 130, 140. Indeed the present invention can be configured to couple a sighting device 110 to a unitary mounting assembly via a single ring assembly 120. These and other implementation configurations are contemplated and within the scope of the present invention.

Figure 5:
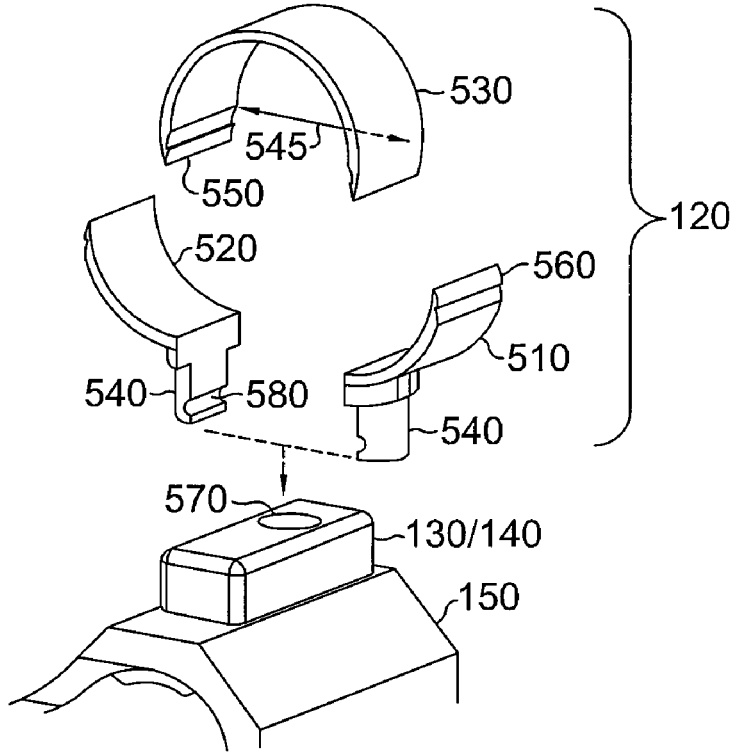
FIG. 5 shows an exploded perspective view of a ring assembly and an associated mounting assembly according to one embodiment of the present invention.

FIG. 5 shows an exploded perspective view of a ring assembly 120 and an associated mounting assembly 130, 140 according to one embodiment of the present invention. In the embodiment shown, the ring assembly 120 is comprised of two lower portions 510, 520 and an upper portion 530 that when combined form a ring. When joined, the two lower portions of the ring assembly 510, 520 form a cradle on which the sighting device 110 can rest. Each of the lower portions of the ring assembly 510, 520 also form one part of an extension 540 that when intact, is accepted in an opening 570 in the mount assembly 130, 140.

With the formation of a cradle by the combined lower portions of the ring assemblies 510, 520, a sighting device (not shown) can be placed within the cradle and secured by coupling the upper portion of the ring assembly 530 to the lower portions of the ring assembly 510, 520. In one embodiment of the present invention the upper portion of the ring assembly 530 is configured to have an opening diameter 545 slightly less than that of the cradle formed by the lower portions of the ring assemble 510, 520 yet with a latching surface 550 designed to overlap a receiving surface 560 on the upper lips of the cradle. As the latching surface 550 of the upper portion 530 engages the receiving surface 560 of the lower portions 510, 520 of the cradle, the cradle is elastically deflected inward. This inward force is translated to the bifurcated extension 540 within the mount assembly 130/140. The upper portion of the ring assembly 530 engages a latch on each of the lower portions of the ring assembly 510, 520 forming the ring.

In use, a sighting device is placed within the cradle and then secured to the mounting device by affixing the top portion of the ring assembly 530 to the lower portions of the ring assembly 510, 520. In another embodiment the ring assembly is further secured to the mount assembly 130/140 using a pin or other means as is described in subsequent sections of this specification. As one skilled in the art will recognize variations in the how the ring assembly is secured to the mount assembly are possible. In addition other means by which to form a ring and secure it to the mount assembly are contemplated by the present invention and do not deviate from this invention's scope. In addition the preset invention recognizes that sighting devices come in various sizes and shapes. Accordingly the receiving diameter of the cradle and ring formed by the upper portion of the ring assembly 120 can be modified to accept a plurality of different sighting devices while still being coupled to a mounting assembly 130/140.

Embodiments of the present invention form a mounting system in which the sighting device, the ring assembly(s) and the mounting assembly(s) is in fact a system that, once formed, can be mounted to a plurality of firearms without having to be reconfigured. That is, once the sighting device is mounted to the mounting assemblies via the ring assemblies, the sighting device can be mounted to various firearms using the same attached mounting assemblies. Similarly, a plurality of sighting devices, all configured with similar rings and mounting assemblies, can possess the same firearm interface and thus be freely interchanged for use on a single firearm.

Figure 6:
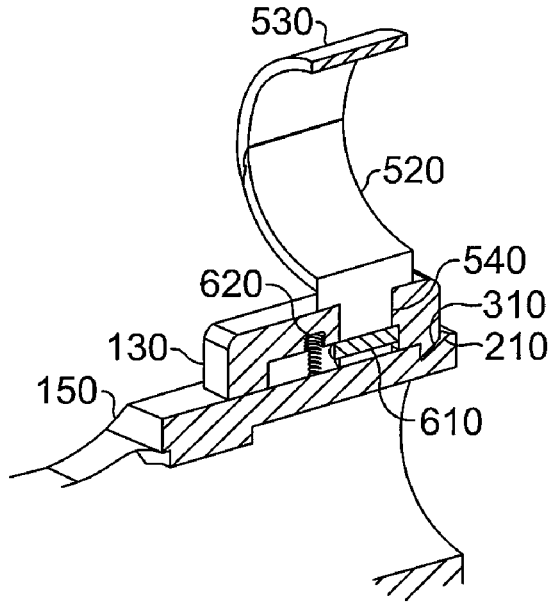
FIG. 6 shows a perspective cutaway view of a portion of a ring assembly coupled to a mounting assembly attached to a firearm according to one embodiment of the present invention.

FIG. 6 a perspective cutaway view of a portion of a ring assembly coupled to a mounting assembly attached to a firearm according to one embodiment of the present invention. FIG. 7 is a side cutaway view of the mounting assembly of FIG. 6 and its associated ring assembly attached to the firearm. As seen in both cutaways, the ring assembly extension 540 occupies a hole in the mount assembly 130. When the two bifurcated portions of the ring assembly are combined they form, in one embodiment of the present invention, a hole 580. Once the extension 540 of the ring assembly 120 is placed within the mount assembly 130, 140 a retention pin 610 is inserted in the hole 580 preventing the ring assembly from backing out of the opening 570 in mount assemblies 130, 140. To prevent the pin 610 from moving once inserted into the hole 580 a set screw 620 is inserted and secured to the mounting assembly 130, 140. As one skilled in the relevant art will recognize other means of securing the ring assembly to the mounting assembly are possible without departing from the spirit of the present invention. These implementation methodologies are known within the art and the specifics of their application within the context of the present invention will be readily apparent to one of ordinary skill in the relevant art in light of this specification.

Figure 7A:
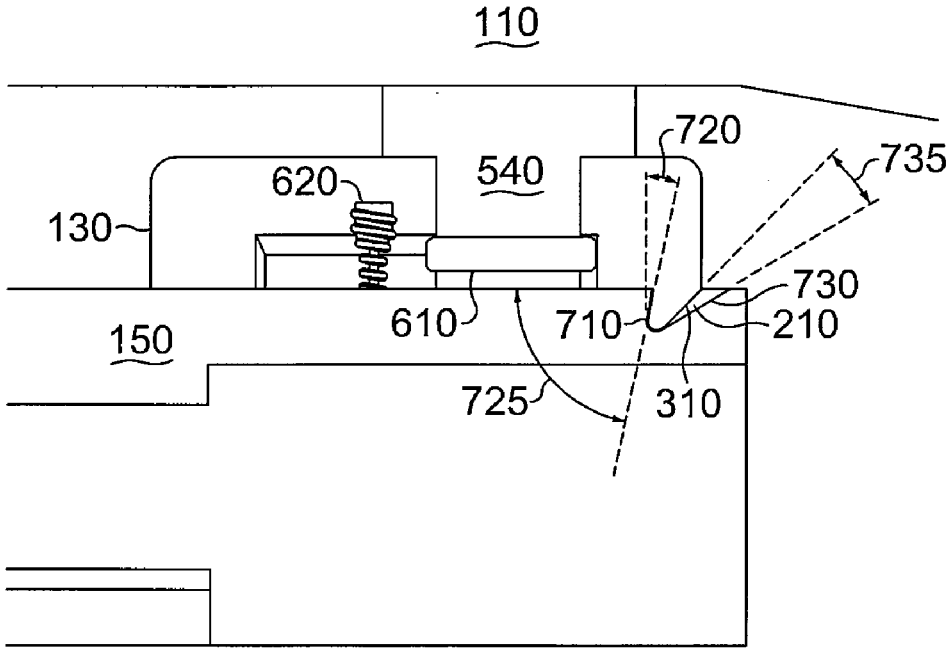
FIG. 7A is a side cutaway view of one embodiment of a first mount assembly and its associated ring assembly attached to a portion of a firearm, according to the present invention.

FIGS. 6 and 7A also show the interaction of the mounting extension 310 of the mount assembly 130 and the receptacle 210 machined into the upper surface of the firearm 150. In FIGS. 6 and 7, the first mount assembly 130 is shown in its mounted state. Accordingly, the mounting extension 310 is fully engaged in the mounting receptacle 210. As can be seen in FIG. 7, the inner edge 710 of the mounting receptacle is inclined at an angle 720 as measured from a line perpendicular to the mounting surface. Similarly, the mounting extension 310 extends from the mounting assembly 130 at a complementary angle 725. When joined, the overlapping angle prevents the mounting assembly from any vertical movement. In the same manner, the elliptical contour of the mounting receptacle 210 prevents any lateral movement.

In its mounted state, the right-most edge of the mounting extension 310 of the mounting assembly 130 is not in contact with the outer edge 730 of the mounting receptacle 210. The angular void 735 allows the mounting assembly 130 to rotate forward disengaging the overlap of the rear surfaces for installation or removal. Thus, when the mounting assembly 130 is prevented from rotating forward by securing the second mounting assembly 140 to the firearm 150 by means of the connector 230, the mounting system is secured to the firearm.

Figure 7B:
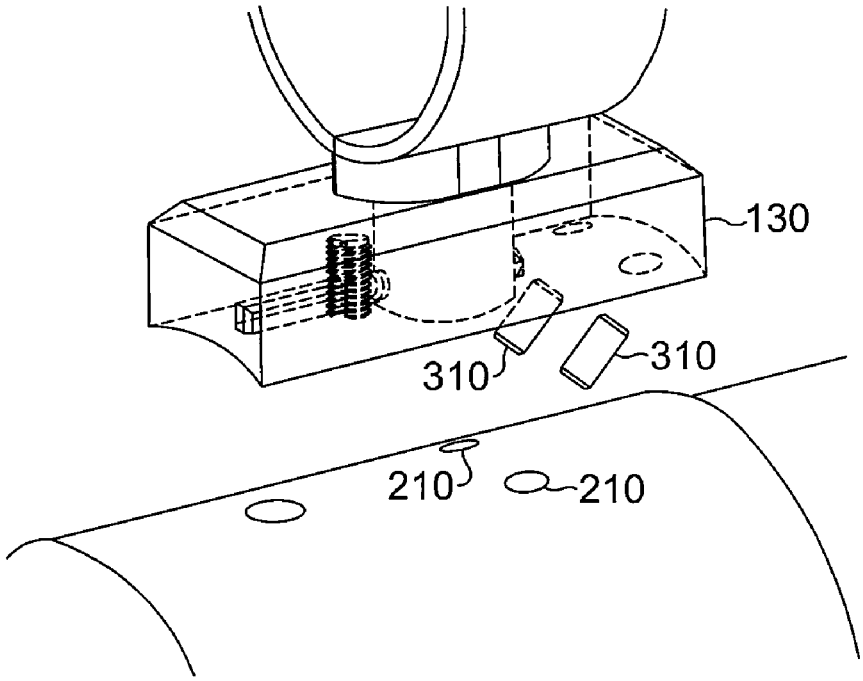
FIG. 7B is a side cutaway view of another embodiment of a first mount assembly and its associated ring assembly attached to a portion of a firearm, according to the present invention.
Figure 7C:
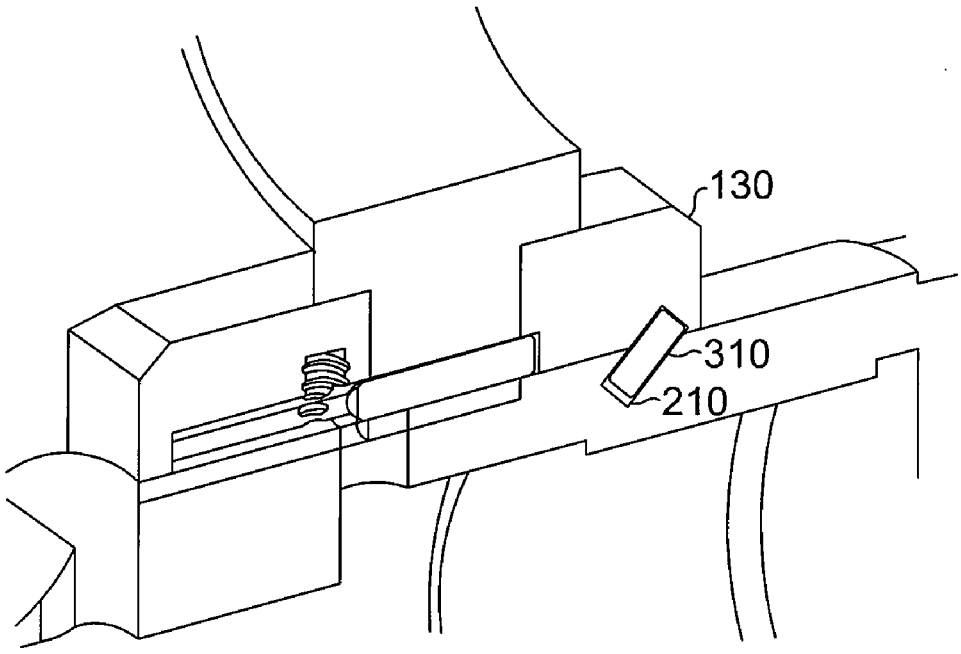
FIG. 7C is a perspective transparent exploded view of another embodiment of a first mount assembly and its associated ring assembly attached to a portion of a firearm, according to the present invention.

FIGS. 7B and 7C show two different embodiments of the first mount assembly 130 and its associated ring assembly 120 as attached to a firearm 150. In the embodiment shown in FIGS. 7B and 7C the firearm's upper surface is curved and thus the lower surface of the mount assembly 130 is machined to a matching curvature to facilitate maximum surface area contact. In FIG. 7B a single mounting extension aligned with the centerline of the mounting assembly 130 protrudes from the assembly and into a firearm receptacle 210. In this embodiment of the present invention the extension 310 is a single cylindrical pin extending at an acute angle orientated toward the second mount assembly as measured for the surface of the assembly. In other embodiments a conical pin and corresponding receptacle is used to facilitate the mounting and alignment process.

FIG. 7C shows a variation of the mounting implementation shown in FIG. 7 B. In FIG. 7C the first mounting assembly 130 includes two cylindrical extensions 310 bilaterally displaced from the assembly's centerline protruding from its lower surface. Each extension 310 is again orientated at an acute angle directed toward the second mount assembly. Two receptacles 210 fashioned into the surface of the firearm 150 each receive one of the extensions 310 associated with the mount assembly 130. As one skilled in the relevant art will recognize the actual geometrical implementation of the interface between the mounting assemblies 130, 140 and the firearm 150 or mounting surface can vary without diminishing the novel aspects of the present invention. Indeed with respect to the receptacles 210 a convex reverse radius cut can be used for rounded bodies while a concave cut can be utilized for a flat top firearm.

Figure 8:
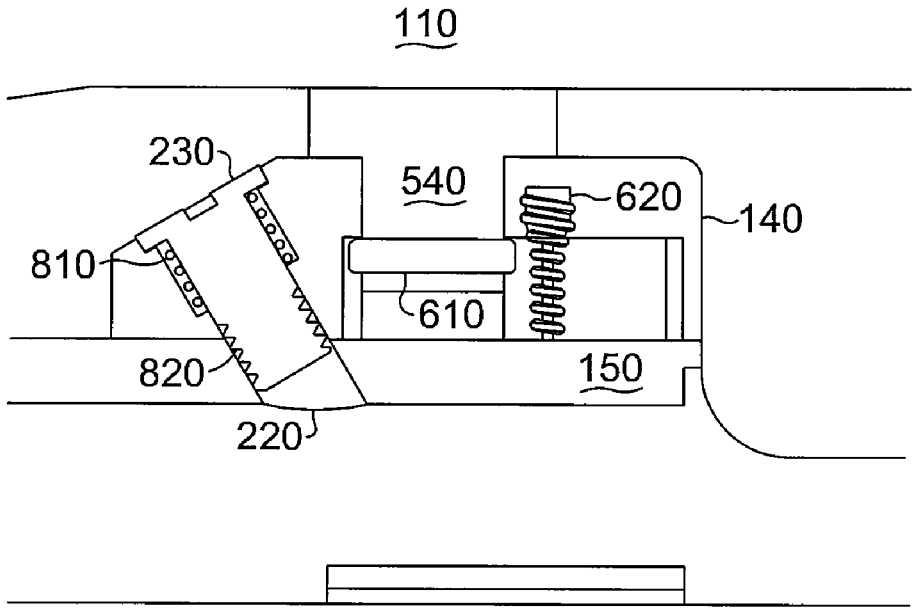
FIG. 8 is a side cutaway view of one embodiment of a second mount assembly and its associated ring assembly attached to a portion of a firearm, according to the present invention.

FIG. 8 is a side cutaway view of one embodiment of the second mounting assembly 140 and its associated ring assembly 120 attached to a portion of a firearm 150, according to the present invention. As with the forward assembly 130 shown in FIGS. 6 and 7, the back assembly 140 includes the ring extension 540 and a pin 610 securing the ring assembly 120 to the mounting assembly 140. Again, a set screw 620 prevents the pin 610 from becoming dislodged.

With the mounting extension 310 of the first mounting assembly 130 firmly engaged within the first mounting receptacle 210, the second mounting assembly 140 lies over the second receptacle 220 in alignment with the connector 230. In one embodiment the connector 230 secures the second mounting assembly 140 to the firearm 150 by threading a bolt or similar connector into the firearm 150. The engaging threads 820 of the connector 230 drives the mounting extension 310 of the first mounting assembly 130 into the inner edge 710 of the first (mounting) receptacle 210 while simultaneously securing the second mounting assembly 140 to the firearm 150. In addition and according to another embodiment of the present invention, the connector 230 can be configured to secure the mounting system to the firearm (or release) using readily available tools such as a coin and with minimal movement. For example, a connector designed to fit a coin can be configured to secure the mounting system to the firearm with a 180 degree or less turn of the connector and be configured with a spring 810 to assist in gaining affirmative contact between the connector 230 and the firearm 150.

One skilled in the relevant art will recognize that the orientation of the mounting assemblies with respect to the front or rear of the firearm is arbitrary. And while the Figures presented herein depict the first mounting assembly 130 positioned near the front of the firearm and the second mounting assembly 140 positioned at the rear of the firearm the present invention can just as effectively be implemented by positioning the first mounting assembly 130 near the rear of the firearm and the second mounting assembly 140 near the front of the firearm.

Figure 9:
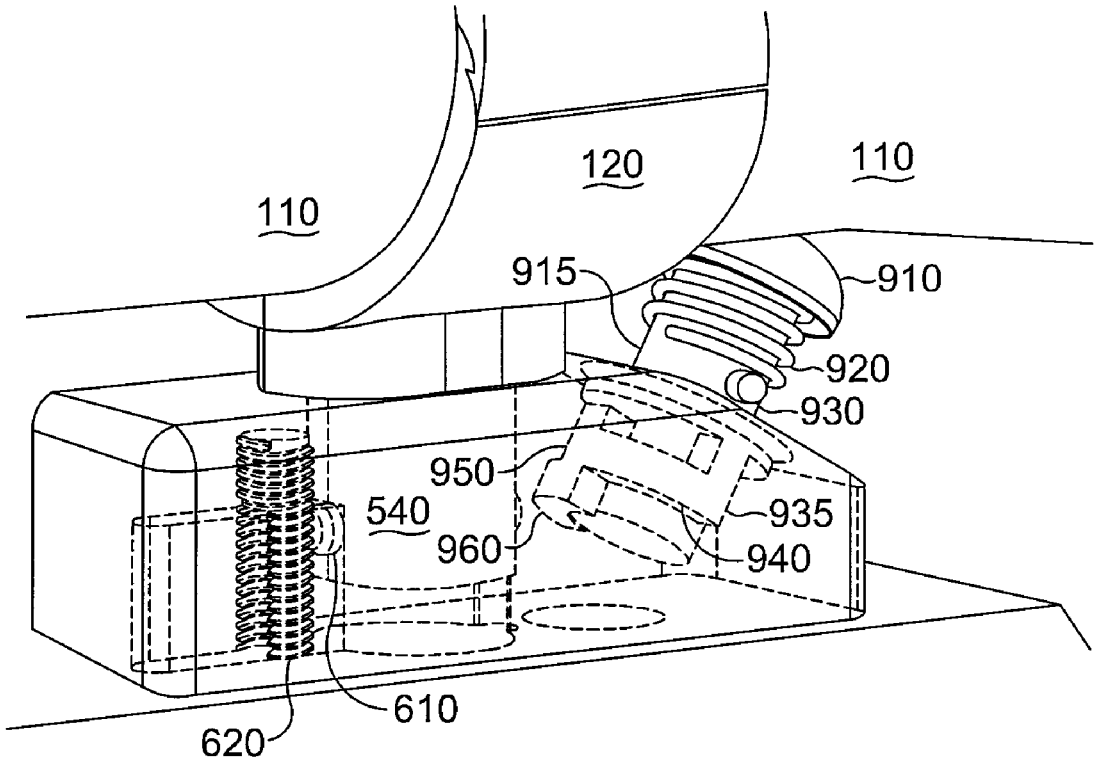
FIG. 9 is a front semi-transparent perspective view of a second mount assembly showing a connector operable for coupling the back mount assembly to a firearm according to one embodiment of the present invention.

FIG. 9 shows a front perspective semi-transparent view of a second mounting assembly 140 and its associated connector 230 according to one embodiment of the present invention. In this embodiment of the present invention, the connector 230 includes a head region 910 and a shaft region 915 wherein each possesses different cylindrical dimensions. The shaft 915 is configured to be of a diameter less than that of the receptacle in the second mount assembly 140 to allow the connector 910 to engage the mount assembly 140 as well as the firearm 150. As can be seen in FIG. 9, a pin 930 extends laterally from the shaft and in the connector's retracted state is aligned with a vertical groove 935.

With the second mount assembly 140 being positioned on the firearm 150 such that the receptacle in the firearm 220 and the connector receptacle associated with the mount assembly 150 are aligned, the shaft region 915 can be extended into the connector receptacle (and the firearm receptacle 220) to engage the firearm 150. As the connector shaft 915 translates the connector receptacle, the pin 930 travels along a vertical groove 935. After traveling a short distance, the pin 930 reaches the end of the vertical groove 935 giving it access to a horizontal channel 940. By rotating the connector 230 the pin 930 travels the length of the channel 940 exposing the pin 930 to another vertical goove 950. Again, the shaft region 915 of the connector 230 can be extended into the connector receptacle as well as the firearm receptacle 220. As the pin reaches yet another vertical limit the pin 930 is again provided access to a horizontal channel 960. The connector 230 can once again be horizontally rotated in the channel 960 until the end is reached. With the pin 930 positioned at the end of the second horizontal channel 960 the associated connector couples the second mount assembly 140 to the firearm 150. The angled nature of the connector 230 prevents the mount assembly 140 from any vertical or horizontal movement thus securing the mounting system to the firearm 150. In another embodiment a spring or similar device 920 is positioned around the shaft region 915 to provide a positive negative pressure on the pin 930 once the connector is extended into the mount assembly connector receptacle. In another embodiment of the present invention the connector/receptacle interaction found in the mount assembly can also exist in the firearm receptacle 220.

Figure 10:
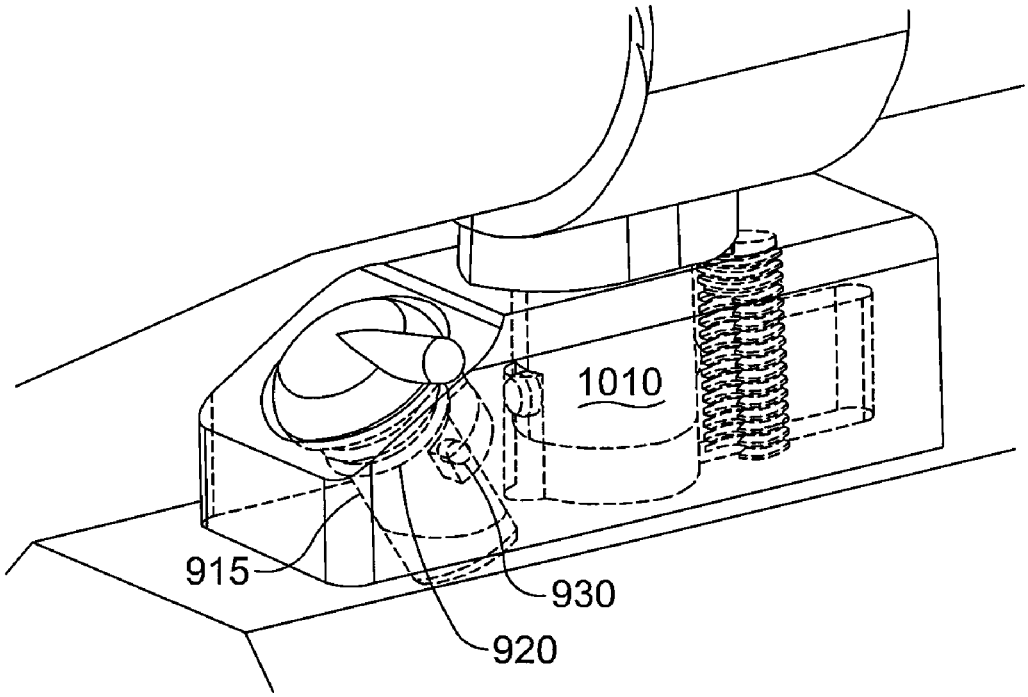
FIG. 10 is a rear semi-transparent perspective view of a second mount assembly showing the connector of FIG. 9 engaging the firearm according to one embodiment of the present invention.

FIG. 10 shows a rear semi-transparent perspective view of one embodiment of the present invention of the second mount assembly/connector interface of FIG. 9 in a fully engaged configuration. In this depiction the connector 230 is fully rotated such that the spring 920 is compressed and the pin 930 is positioned within the second horizontal channel 960. The spring 920 places a positive retractile force between the pin 930 and the upper wall of the second horizontal channel 960. The ensuing friction assists in securing the connector 230 in this the fully engaged configuration. Also shown in FIG. 10 is a thumb latch 1010 which can assist a user in turning the connector 230 during the engagement process.

In another embodiment of the present invention one or more of the mounting assemblies can possess additional three dimensional relief to aid in developing a secure and accurate interaction with the firearm. In addition to the first and second receptacle, a pattern of ridges and valleys of various geometric shapes can be formed on and extending from the bottom surface of the mounting assemblies. A mirror relief image of the geometric ridges and valleys can be machined into the upper surface of the firearm. When the mounting assemblies properly engage the firearm via the first and second receptacle, the ridges can fit into the machined grooves thus increasing surface area contact and offering additional lateral stability. Such increased interaction between the mounting assemblies and the firearm can aid in reducing variance due to vibration and aid in making the alignment of the mounting assembly to the firearm's bore more reliable.

As previously mentioned, the formation of a single interchangeable component, comprising the mounting system and a sighting device that can be removed from one firearm to another, is a significant departure for mounting systems known in the prior art. Similarly, the ability for a single firearm to quickly remove one sighting device in favor of another sighting device is a major advantage over the prior art.

To better understand the utility of the present invention consider the scenario of a sportsman having several firearms and several sighting devices. Each sighting device is configured with a separate set of ring assemblies and mounting assemblies set so as to form a consistent mounting footprint. Similarly each of the firearms has been configured to include a first and second receptacle consistent with the mounting footprint. Note that other than the two receptacles, the firearms remain unchanged and indeed the aesthetic qualities of the firearms are unchanged. Many firearms possess extensive scroll work and machining to enhance the appearance and value of the firearm. Mounting systems of the prior art impede these aesthetic qualities and in some cases destroy them. The mounting receptacles of the present invention can be configured to minimize any aesthetic impact and in some cases be used to enhance the firearm's appearance.

For any given situation the sportsman may wish to use a particular type of firearm combined with a particular sighting device. It also important to understand that ease of changing between sighting devices on a particular firearm or moving a favorite sighting device from one firearm to another is significant, especially in field conditions. For example, a sportsman may be hunting using a particular firearm configured with a sighting device using the mounting system of the present invention. Upon sighting prey, the sportsman may realize that he is using the wrong type of weapon and wish to exchange the sighting device on the present firearm to the firearm more appropriate for the current situation.

According to an embodiment of the present invention, the sportsman can quickly remove the existing sighting device from his current firearm by releasing the connector on one of the mounting assemblies (perhaps by using a coin) and rotating the system out of the receptacles. As the second firearm possesses identical receptacles, the sighting device attached to the mounting system can be quickly attached to the second firearm by inserting the first mounting assembly into the first receptacle and securing the second mounting assembly via the connector. Upon installation, the sighting device will be immediately aligned with the bore sight of the firearm. And with a simple elevation adjustment the firearm, is ready to be used. This elevation adjustment can be calibrated and recorded so that upon attachment of a particular sighting device to a particular firearm, the elevation adjustment can be applied making the sighting device accurate on the first firing.

Likewise, a sportsman may find that while he or she has selected the correct firearm the sighting device is not appropriate for the given conditions. By releasing the connector of the current mounting system the current sighting device can be removed and replaced with one meeting the sportsman's needs. The new bore of the sighting device is aligned upon installation and with a simple elevation adjustment the firearm is once again ready for use.

Embodiments of the present invention offer a mounting system to the sportsman that can enable one sighting device to be quickly mounted on a variety of different firearms or a firearm capable of quickly accepting any one of several sighting devices. The mounting system of the present invention can also be used to mount sighting devices to other objects. For example a plurality of sighting devices can be stored on a rack or wall using the mounting system of the present invention. In addition a vehicle or vessel can be modified to include receptacles compatible with the mounting assemblies. In such a manner various sighting devices can be used for long range acquisition of a target in various environmental conditions.

Figure 11:
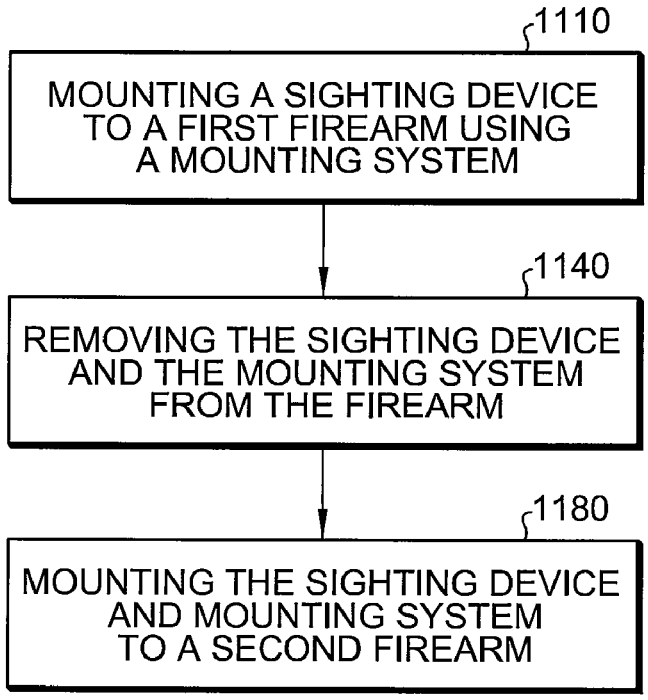
FIG. 11 is a flowchart of one method embodiment for interchanging a sighting device among one or more firearms, according to the present invention.
Figure 12:
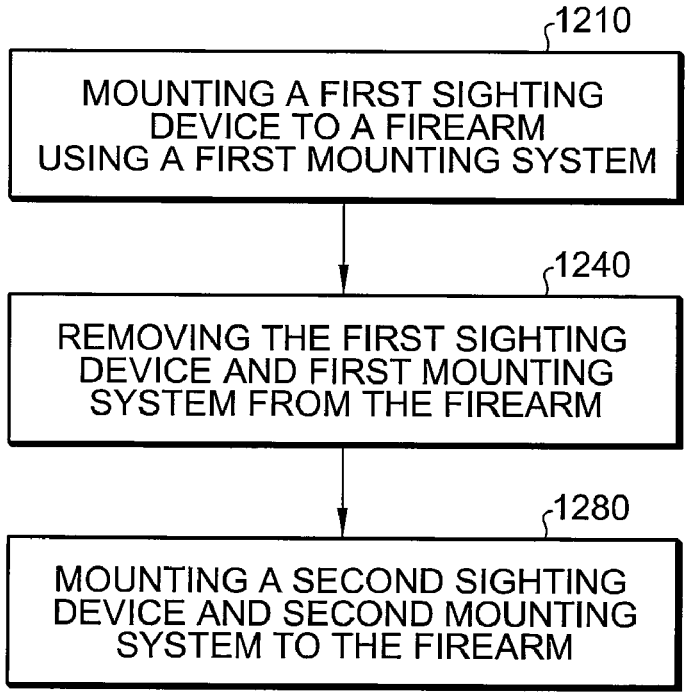
FIG. 12 is a flowchart of one method embodiment for interchanging one or more sighting devices on firearms, according to the present invention.

FIGS. 11 and 12 are flowcharts illustrating methods of implementing an exemplary process for exchanging sighting devices among firearms. In the following description it will be understood that each block of the flowchart illustrations, and combinations of blocks in the flowchart illustrations, can be implemented by computer program instructions. These computer program instructions may be loaded onto a computer or other programmable apparatus to produce a machine such that the instructions that execute on the computer or other programmable apparatus create means for implementing the functions specified in the flowchart block or blocks. These computer program instructions may also be stored in a computer-readable memory that can direct a computer or other programmable apparatus to function in a particular manner such that the instructions stored in the computer-readable memory produce an article of manufacture including instruction means that implement the function specified in the flowchart block or blocks. The computer program instructions may also be loaded onto a computer or other programmable apparatus to cause a series of operational steps to be performed in the computer or on the other programmable apparatus to produce a computer implemented process such that the instructions that execute on the computer or other programmable apparatus provide steps for implementing the functions specified in the flowchart block or blocks.

Accordingly, blocks of the flowchart illustrations support combinations of means for performing the specified functions and combinations of steps for performing the specified functions. It will also be understood that each block of the flowchart illustrations, and combinations of blocks in the flowchart illustrations, can be implemented by special purpose hardware-based computer systems that perform the specified functions or steps, or combinations of special purpose hardware and computer instructions.

As depicted in FIG. 11 one method for interchanging a common sighting device among a plurality of firearms begins with mounting 1110 the sighting device on a first firearm. The sighting device is first secured to a mounting system comprising one or more ring assemblies and two or more mounting assemblies. Note that in other embodiments a single ring assembly can be used and the two or more mounting assemblies can be formed into a unitary component. The mounting system, comprised of the sighting device, the ring assemblies and the mounting assemblies, is mounted to the firearm via two receptacles present in the firearm. The mounting system is secured to the firearm via a single connector at one of the mounting assemblies.

Thereafter, mounting system can be removed 1140 from the first firearm by releasing the connector and disengaging the mounting device from the receptacles found in the firearm. The sighting device, still configured in the mounting system, can then be mounted 1180 on a second firearm. The unaltered mounting system is aligned first with a first receptacle found in the surface of the second firearm and then a second receptacle, also found on the second firearm. The connector within the mounting assembly of the mounting system can then engage the second firearm completing the installation. In a similar manner the same sighting device configured with the mounting system of the present invention can be quickly and reliably mounted on any of a plurality of firearms that possess the two mounting receptacles.

Just as a single sighting device can be quickly and reliably mounted on a plurality of firearms, so too can a plurality of sighting devices be quickly and reliably mounted on a single firearm. Embodiments of the present invention allow a free exchange of several sighting devices, each configured with the mounting system of the present invention, among a plurality of firearms.

As depicted in FIG. 12, a method for exchanging sighting devices on a firearm begins with the mounting 1210 of a first sighting device to a firearm using the mounting system of the present invention. A sighting device is in one embodiment of the present invention, secured to a pair of mounting assemblies using a pair of ring assemblies. The now configured mounting system is then mounted to the firearm by engaging a first of the two mounting assemblies to a receptacle in the surface of the firearm and then connecting the second mounting assembly to the second receptacle via a single connector.

Upon realizing a need to change sighting devices, the first sighting device and its associated mounting assembly can be removed 1240 from the firearm by decoupling the connector and disengaging the two mounting assemblies from their respective receptacles. A second sighting device can then be mounted to the firearm.

As with the first sighting device, the second sighting device is coupled to a pair of mounting assemblies via a pair of ring assemblies forming another mounting system. The interface between the mounting assemblies of both systems and the firearm is identical. Thus the second sighting device and its associated mounting system can be mounted 1280 to the same firearm by engaging the first mounting assembly with the first receptacle and connecting the second mounting assembly with the second receptacle.

Embodiments of the present invention enable a user to freely exchange one or more sight devices among one or more firearms. Rather than remounting the sighting device on a firearm, the present invention exchanges an entire mounting system. In the exchange no components remain on the firearm leaving the aesthetics of the firearm minimally disturbed. Furthermore, the mounting system of the present invention allows a sighting device to be reliably mounted to a firearm so that the firearm is ready to be accurately employed on the first firing.

While there have been described above the principles of the present invention in conjunction with mounting sighting devices to firearms, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

I claim:

1. A firearm sighting attachment comprising:

a first mount assembly configured to engage a firearm at a first engagement location on a firearm and a second mount assembly configured to engage the firearm at a second engagement location on the firearm wherein the first engagement location includes at least one angled extension configured to be accepted in a receptacle associated with the firearm, the receptacle comprising a region on an upper surface of the firearm void of material and including a flat planar surface and an elliptical curvilinear surface and wherein the flat planar surface is inclined at an angle of less than 90 degrees as viewed perpendicularly from the upper surface of the firearm toward the elliptical portion, the flat surface being proximate to the second engagement location and wherein the firearm includes a bore sight; and at least one ring assembly configured to detachably couple a sighting device to each the first mount assembly and the second mount assembly prior to the first mount assembly and the second mount assembly directly engaging the firearm so as to align the sighting device with the bore sight.

2. The apparatus of claim 1, wherein the second mount assembly is affixed to the firearm at the second engagement location subsequent to the angled extension engaging the receptacle at the first engagement location.

3. The apparatus of claim 1, wherein the second mount assembly is affixed to the firearm at the second engagement location using a connector.

4. The apparatus of claim 3, wherein the connector physically draws the second mount assembly together with the firearm at the second engagement location.

5. The apparatus of claim 3, wherein the connector physically draws the first mount assembly together with the firearm at the first engagement location.

6. The apparatus of claim 3, wherein the connector is a bolt.

7. The apparatus of claim 1, wherein coupling the sighting device to the first and second mount assemblies via the at least one ring assembly forms an assembled apparatus having a standard firearm interface.

8. The apparatus of claim 7, wherein the assembled apparatus is directly attachable to the firearm.

9. A firearm sighting attachment comprising:

a first mount assembly configured to engage a firearm at a first engagement location on a firearm and a second mount assembly configured to engage the firearm at a second engagement location on the firearm and wherein the firearm includes a bore sight; and at least one ring assembly configured to detachably couple a sighting device to each the first mount assembly and the second mount assembly prior to the first mount assembly and the second mount assembly directly engaging the firearm so as to align the sighting device with the bore sight wherein the at least one ring assembly includes at least two portions forming a pin that mates with either the first mount assembly or the second mount assembly.

10. The apparatus of claim 9, wherein joining of the upper portion with the two lower portions expands the pin within either the first mount assembly or the second mount assembly.

11. A system for firearm sighting device attachment, the system comprising:

at least two ring assemblies wherein each assembly includes at least two bifurcated portions forming a portion of an extension;

at least two mount assemblies wherein each mount assembly includes a receptacle configured to accept the extension and wherein coupling the at least two bifurcated portions expands the extension engaging the mount assembly, and wherein the at least two ring assemblies couple a sighting device to the at least two mount assemblies respectively and wherein the system is configured to couple the sighting device to the at least two mounting assemblies prior to attaching the at least two mounting assemblies to at least one of a plurality of firearms so as to align the sighting device with a bore sight of the firearm.

12. The system of claim 11 wherein each at least two ring assemblies includes an upper portion and a lower portion and wherein the lower portion forms a cradle for receiving the sighting device and wherein the upper portion couples with the lower portion securing the sighting device.

13. The system of claim 11, wherein the firearm includes two or more recesses configured to accept a connector associated with each of the at least two mount assemblies.

14. The system of claim 13, wherein a first recess includes a receptacle having an inclined face configured to accept the connector associated with a first mount assembly such that the connector engages the inclined face, and wherein a second recess having an incline opposite to the inclined face is configured to accept the connector associated with a second mount assembly.

15. The system of claim 14, wherein the connector associated with the second mount assembly is a bolt.

16. The system of claim 14, wherein the connector associated with the second mount physically draws the firearm and the second mount assembly together.

17. The system of claim 11, wherein the at least two mounting assemblies are joined forming a single mounting component.

18. A system for firearm sighting device attachment, the system comprising:

at least two ring assemblies wherein each assembly includes an upper portion and a bifurcated lower portion and wherein the bifurcated lower portion of each of the at least two ring assemblies when combined forms an extension;

at least two mount assemblies wherein each mount assembly includes a receptacle configured to accept the extension and wherein coupling the at least two bifurcated portions to the upper portion expands the extension engaging the mount assembly, and wherein the at least two ring assemblies couple a sighting device to the at least two mount assemblies respectively and wherein the system is configured to couple the sighting device to the at least two mounting assemblies prior to attaching the at least two mounting assemblies to at least one of a plurality of firearms so as to align the sighting device with a bore sight of the firearm.

* * * * *